United States Patent [19]

Townsend

[11] 4,257,172

[45] Mar. 24, 1981

[54] COMBINATION FORCED AIR AND INFRARED DRYER

[75] Inventor: Newton A. Townsend, Shelton, Wash.

[73] Assignee: Olympic Infra-Dry Inc., Shelton, Wash.

[21] Appl. No.: 4,996

[22] Filed: Jan. 22, 1979

[51] Int. Cl.[3] ..... F26B 15/18

[52] U.S. Cl. ..... 34/68; 34/17; 34/39

[58] Field of Search ..... 34/4, 17, 18, 39, 42, 34/68, 224, 34; 250/492 R, 495, 504

[56] References Cited

U.S. PATENT DOCUMENTS

| | | | |
|---|---|---|---|
| 3,448,526 | 6/1969 | Smith, Jr. | 34/68 X |
| 3,720,002 | 3/1973 | Martin | 34/68 X |
| 3,826,014 | 7/1974 | Helding | 250/504 X |
| 3,900,959 | 8/1975 | Breschi et al. | 34/155 |
| 3,930,318 | 1/1976 | Stelter et al. | 34/41 X |
| 3,936,950 | 2/1976 | Troue | 34/4 |
| 4,019,062 | 4/1977 | Rongren | 250/504 X |
| 4,118,873 | 10/1978 | Rotchild | 250/492 R |

FOREIGN PATENT DOCUMENTS

| | | | |
|---|---|---|---|
| 757250 | 3/1971 | Belgium | 34/4 |
| 287956 | 12/1952 | Switzerland | 34/68 |

*Primary Examiner*—Albert J. Makay
*Assistant Examiner*—Harold Joyce
*Attorney, Agent, or Firm*—Seed, Berry, Vernon & Baynham

[57] ABSTRACT

A dryer for removing vaporous substances from products in which the product sequentially passes beneath an array of ventilating nozzles and an array of infrared heaters. The dryer includes a generally rectangular frame forming a central drying zone having an infeed end and an outfeed end. The array of ventilating nozzles is positioned at the infeed end of the drying zone in order to quickly remove surface moisture from the product. The downstream array of infrared heaters removes residual surface moisture and moisture beneath the surface of the product. The ends of the heaters project into a pair of inlet ducts extending along opposite sides of the frame so that the ends of the heaters are cooled by air flowing through the ducts. Air flows through the ducts from an inlet near the outfeed end of drying zone to a blower manifold where the air is mixed with recirculated gases from the ventilating nozzles and air entering the infeed end of the drying zone before being conveyed to the blower. Each of the heaters is covered by a semi-cylindrical reflector having their edges spaced apart from each other to form ventilating passages therebetween. Air flows through the ventilating passages located between the infrared radiation elements onto the product in order to remove a boundary layer of vapor which would otherwise absorb infrared radiation. A flexible belt extends beneath the drying zone and continuously carries product end beneath the array of the heater elements and ventilation nozzles.

4 Claims, 4 Drawing Figures

COMBINATION FORCED AIR AND INFRARED DRYER

BACKGROUND OF THE INVENTION

1. Field of the Invention

This invention relates to dryers for removing vaporous substances such as paint from a product and, more particularly, to a dryer utilizing both infrared heaters and ventilating nozzles.

2. Description of the Prior Art

Infrared heaters have long been used to remove vaporous substances such as paints, adhesives and moisture from products of various types. These dryers generally include an array of infrared heaters beneath which the products pass. In order to dissipate heat imparted by the heaters to the surrounding support structure, the support structure is generally open to allow good convective cooling and facilitate heat radiation. Thus, a substantial quantity of power utilized by these existing dryers is converted to heat which does not perform any useful purpose.

Another problem associated with existing infrared heaters is that a substantial portion of the infrared radiation radiated to the product is absorbed by a vapor barrier which builds up on the surface of the products. Thus, only a portion of the radiation radiated to the product is effective in removing the vaporous substance from the product.

An entirely different variety of dryer for removing vaporous substances from a product directs air which is often heated onto the product. Although this variety of dryer is more effective than the infrared variety in removing surface moisture, it is not as capable of removing deeper moisture. Also, most of the power used by this variety of dryer is used by the heating element for the air and not by the mechanism for producing the air flow. Although product may have been previously exposed to an infrared dryer and then a forced air dryer in sequence, no attempt has been made to utilize the excess heat generated by the infrared dryer to heat air flowing from the forced air dryer.

SUMMARY OF THE INVENTION

It is an object of the invention to provide an infrared dryer capable of removing a vapor barrier from the surface of a product to maximize the efficiency of the dryer.

It is another object of the invention to provide a combination infrared and forced air dryer which utilizes the excess heat generated by the infrared heaters to heat forced air flowing onto the product.

It is still another object of the invention to provide a combination infrared and forced air dryer which partially recirculates the heated forced air in order to more efficiently utilize the heat imparted to the air by the infrared heaters.

It is still another object of the invention to provide a combination infrared and forced air dryer utilizing air flow for both cooling the dryer structure and removing vaporous substances from a product.

It is a further object of the invention to provide a mounting structure for an array of infrared heater elements which facilitate cooling of the mounting structure for the elements.

These and other objects of the invention are accomplished by an array of infrared heaters having ventilating passages extending through the array. A blower directs air through the ventilating passage onto product which is carried by conveying means beneath the array. The air flowing through the ventilating passage remove a boundary layer of vapor forming on the surface of the product to minimize reflection of infrared radiation from the surface of the product. The infrared heaters are preferably elongated and are covered by a semi-cylindrical reflector with the adjacent edges of adjacent reflectors spaced apart from each other to form a plurality of ventilating passages. The ends of the infrared heaters preferably project through respective spaced apart bulkheads which form an air inlet to the ventilating passages so that the air, by cooling the heater mounting structure, becomes heated for subsequent use. An array of ventilating nozzles may be positioned upstream from the infrared heater array so that surface moisture is initially removed from the produce before residual surface moisture or other vaporous substances and below surface moisture is removed by the infrared heaters. The ventilating nozzles directed heated air onto the product. The air flowing through the ventilating nozzles are preferably received from the inlet ducts to which the infrared tubes are mounted so that the air flowing through the ducts not only cools the heater support structure, but is also heated for subsequent ulization by the forced air dryer. Air is forced through the ventilating passages in the infrared heater array and the ventilating nozzles by a blower receiving air from a manifold positioned upstream of the ventilating nozzles. The inlet ducts open into the manifold, and the manifold has an open bottom so that it may receive recirculated air from the ventilating nozzles. Consequently, a portion of the air received by the blower is air recirculated through the product thereby preserving some of the heat previously imparted to the air. A portion of the air flowing from the blower is directed to an exhaust outlet to prevent the concentration of vapor in the air from becoming excessive

DETAILED DESCRIPTION OF THE INVENTION

Figure 1:
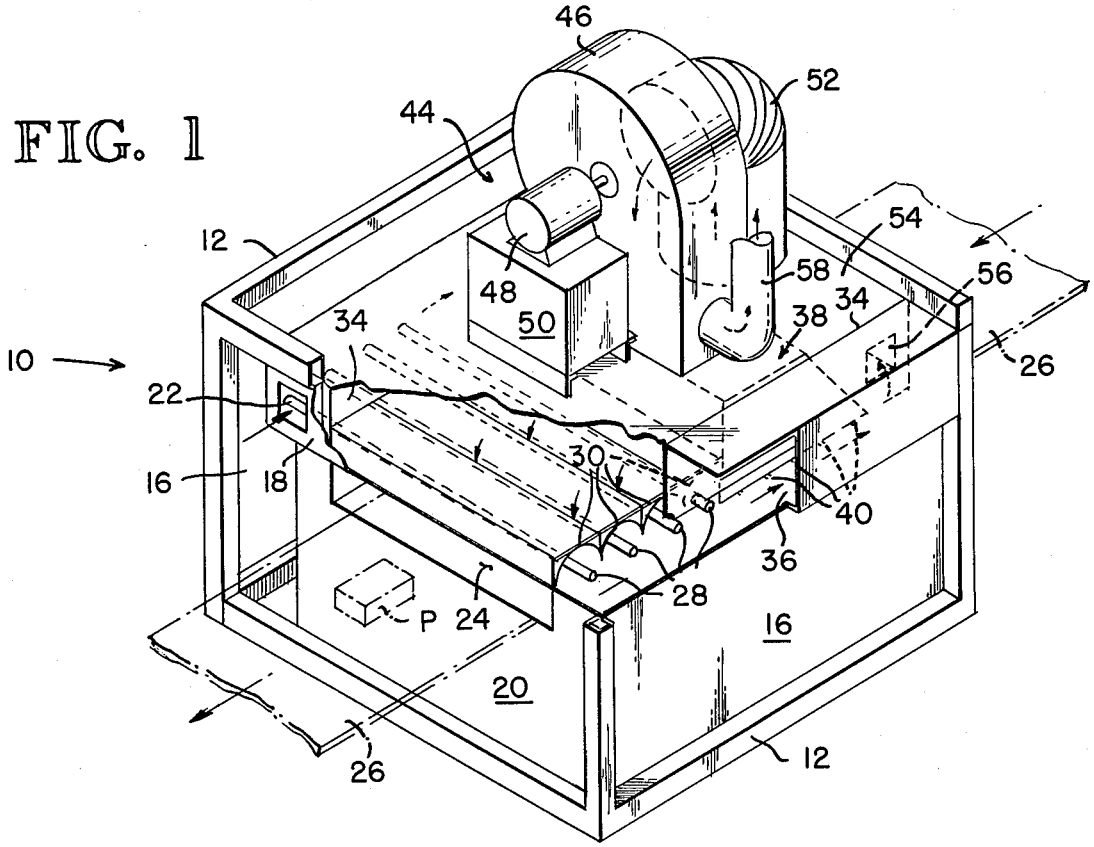
FIG. 1 is an isometric view illustrating the combination forced air and infrared dryer.

The dryer 10, as illustrated in the figures, includes a frame 12 of generally box-like configuration. The sides of the frame 12 are closed by panels 16 while the infeed and outfeed ends of the frame 12 are closed by respective upper panels 18 and lower panels 20. A pair of cutouts 22 are formed at opposite sides of the upper panel 18 at the outfeed end to form air inlets, and a central cutout 24 is formed along the upper edge of the lower panel 20 at both the outfeed and infeed end to form a dryer zone. A continuous flexible belt 26 is propelled by a conventional drive means (not shown) so that it moves from left to right as illustrated in FIGS. 1 and 4.

Figure 4:
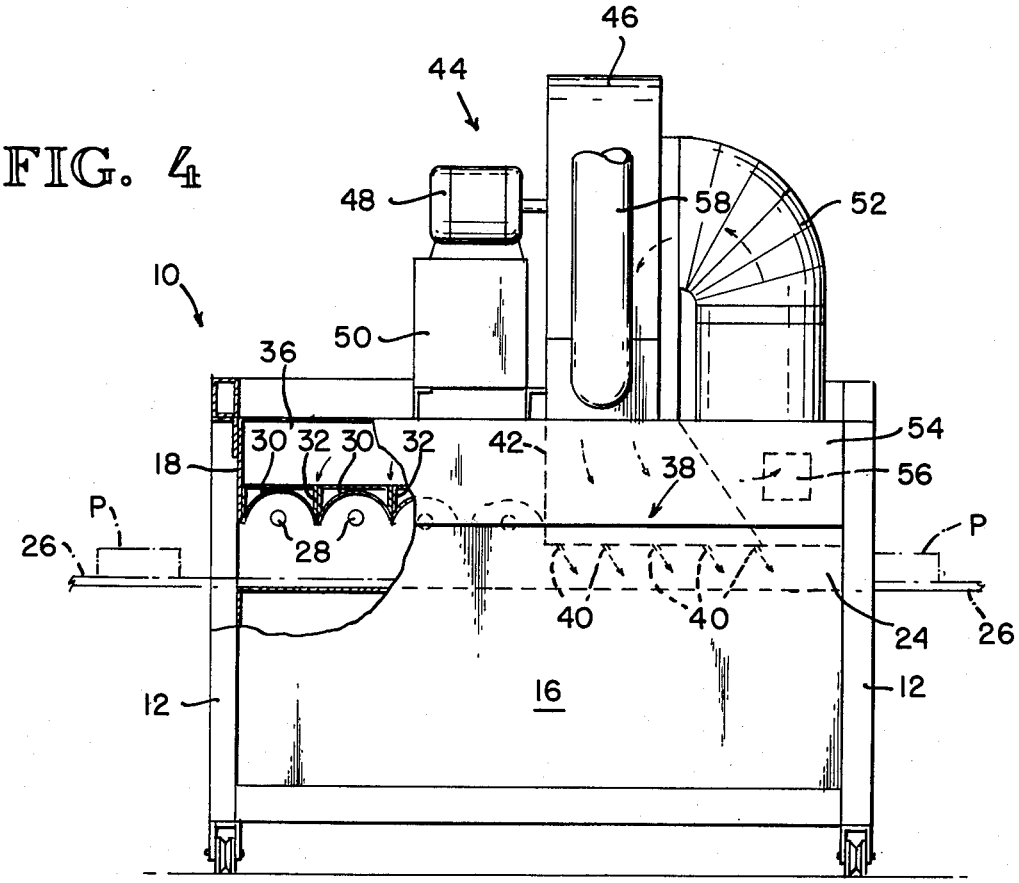
FIG. 4 is a side elevational view of the dryer partially broken away illustrating the flow of air through the dryer.

An array infrared heaters 28 is mounted in the dryer zone 24 toward the outfeed end thereof as best illustrated in FIGS. 1 and 4. Each of the heaters 28 is covered by a semicylindrical reflector 30 for directing the infrared radiation downwardly onto the belt 26. As best illustrated in FIG. 4, the adjacent edges of adjacent reflectors 30 are spaced apart from each other to form ventilating passages 32 therebetween. A product P is carried beneath the infrared heaters 28 by the belt 26 receives infrared radiation from the heaters 28. The product P will normally contain a vaporous substance which is to be removed by the dryer 10. Often the substance causes a vapor barrier to be created along the surface of the product P which reflects infrared radiation. To alleviate this problem, gases flow through the ventilating passages 30 to remove the vapor barrier so that the infrared radiation can effectively remove the vaporous substance from the product P.

Figure 2:
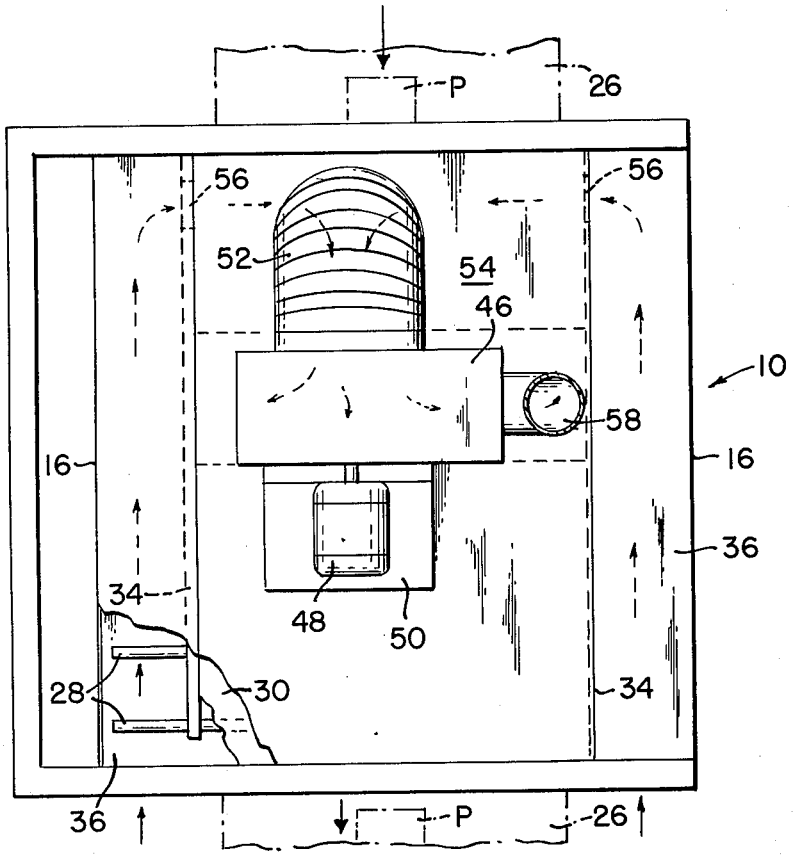
FIG. 2 is a top plan view of the dryer illustrating the flow of air through the dryer.
Figure 3:
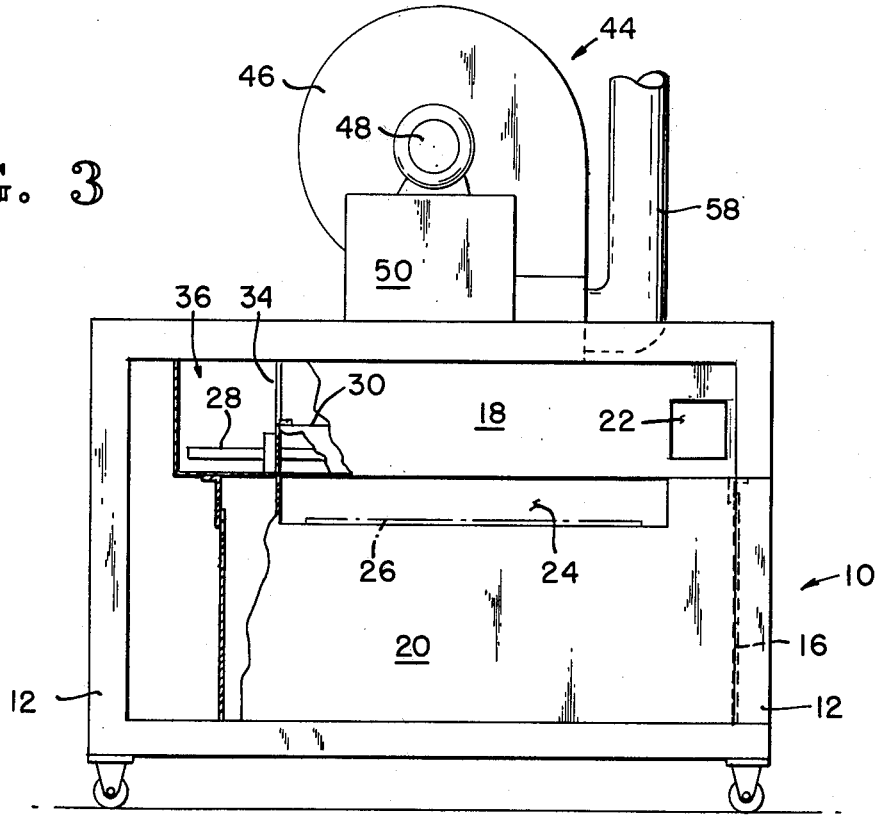
FIG. 3 is a side elevational view of the dryer.

As best illustrated in FIGS. 2 and 3, the ends of the infrared heaters 28 project through a bulkhead 34 into an inlet duct 36 partially formed by the bulkhead 34. The heaters 28 are secured to the bulkhead by conventional means. The inlet duct receives fresh air from the inlet openings 22 formed in the upper panel 18 at the infeed end. This air flows through the duct 36 toward the infeed end of the dryer 10 where it cools the bulkhead 34 and becomes heated for subsequent utilization.

With reference to FIG. 4, an array of ventilating nozzles 38 is positioned in the dryer zone 24 upstream from the infrared heaters 28 so that the product P passes beneath the ventilating nozzles 38 and heaters 28 in sequence. The gases flowing onto the product P from the nozzles is highly effective in removing moisture or other vaporous substances from the surface of the product. The ventilating nozzles are formed by a plurality of baffles 40 extending transversely across the drying zone 24 at the lower end of an outlet duct 42. The baffles 40 direct the gases toward the infeed end of the dryer away from the infrared heaters 28 in order to prevent a substantial quantity of potential flammable gases from reaching the heaters 28. Gases are pumped into the duct 28 by a conventional blower 44 including a fan 46 driven by a conventional electric motor 48 mounted on a pedestal 50. The fan 46 receives gases from a curved cylindrical duct 52 which in turn receives gases from a blower manifold 54. The blower manifold has an open bottom so that it receives gases directly from the dryer zone below. These gases are a mixture of recirculated gases principally from the ventilating nozzles 38 and fresh air entering through the inlet of the drying zone 24. The manifold 54 also receives hot fresh air from the inlet duct 36 through respective apertures 56. Thus, the gases reaching the blower 46 is a mixture of hot fresh air from the inlet 22, fresh air from the inlet end of the drying zone 26 and recirculated gases from the ventilating nozzles 38 and ventilating passages 32. The mixture contains sufficient fresh air so that the gases leaving the blower 44 are not vapor saturated yet they are mixed with sufficient recirculated air to more efficiently utilize heat generated by the heaters. A portion of the gas received by the blower 44 is directed into an exhaust outlet 58. Thus, as best illustrated in FIGS. 1, 2 and 4, fresh air flows through inlet 22, inlet duct 36 into the blower manifold 54 through aperture 56. Additional gas enters the manifold 54 from the drying zone 24 beneath the manifold 54. Gases from the manifold 54 are received by the blower 44 which directs most of the gas through ventilating nozzles 38 and a lesser amount through ventilating passages 32.

It is important that the gases flowing from the nozzles 38 have sufficient velocity to allow them to remove moisture. The velocity of the gases should generally be at least 500 feet per minute in order to accomplish this function. Generally, the velocity of the gases flowing through the ventilating passages 32 should be somewhat less since it is not desirable to carry the heat away from the reflectors 30 and heaters 28 too rapidly. Thus, the velocity of the gases flowing through the ventilating passages 32 should be less than 900 feet per minute.

Although the composition of the gases entering the manifold 54 may vary to some extent, in one operational embodiment about 20% of the air entering the manifold 54 is fresh air from the inlet duct 36, 30% of the air is unheated flowing through the drying area 24 from the inlet end and 50% of the gases are recirculated from the ventilating nozzles 38 or ventilating passages 32. A lesser quantity of fresh air from the inlet ducts 36 do not provide sufficient cooling, and a greater amount of recirculated air tends to cause the gas flowing from the ventilating nozzles 40 to have an excessive vapor concentration.

Although the inventive combination forced air and infrared dryer will principally find application as a paint dryer, it will be understood that a wide variety of other uses are contemplated such as to dry adhesives from wood products or moisture from bakery products.

I claim:

1. An apparatus for drying a product to remove a vaporous substance therefrom, comprising:

an array of elongated infrared heaters having a ventilating passage extending therethrough, said heaters having their ends projecting through respective, spaced apart bulkheads to which said heaters are secured;

conveying means for carrying said product beneath said array; and blower means for directing a gas through said ventilating passage onto said product thereby cooling said heaters and removing boundary layer of vapors from said product, said blower means including a pair of ducts formed by said bulkheads allowing gas to flow from a gas inlet to said ventilating passages such that the ends of said heaters project into said ducts where they are cooled by gas flowing through said ducts.

2. An apparatus for drying a product to remove a vaporous substance therefrom, comprising:

a frame having a generally boxlike configuration;

a central drying zone having an infeed and an outfeed end formed in said frame;

a pair of inlet ducts extending along opposite sides of said drying zone from an inlet at the outfeed end of said drying zone toward the infeed end thereof;

a plurality of horizontally spaced, elongated infrared heaters extending transversely across said drying zone adjacent the outfeed end thereof, with the ends of said heaters projecting into said inlet ducts such that the ends of said heaters are cooled by air flowing through said ducts;

a semi-cylindrical reflector positioned above each of said heaters, the adjacent edges of adjacent reflectors being spaced apart from each other to form ventilating passages therebetween;

a plurality of horizontally spaced ventilating nozzles positioned in said drying zone toward the infeed end thereof;

blower means directing gas from said inlet ducts to said ventilating passages and said ventilating nozzles; and conveying means for carrying said product through said drying zone from the infeed end to the outfeed end thereof.

3. The apparatus of claim 2 further including a blower manifold positioned at the infeed end of said drying zone from which said blower means receives gas, said manifold opening into said drying zone toward the infeed end thereof, and an air passage extending from each inlet duct into said blower manifold such that air flowing from said inlet ducts to said blower means is mixed with gas previously directed onto said product by said ventilating passages and said ventilating nozzles.

4. The apparatus of claim 3 further including an exhaust outlet receiving gas from the said blower means.

* * * * *